US010267224B2

(12) United States Patent
Meldolesi et al.

(10) Patent No.: US 10,267,224 B2
(45) Date of Patent: Apr. 23, 2019

(54) INTERNAL COMBUSTION TEST ENGINE WITH SYSTEM AND METHOD FOR ADJUSTING CYLINDER OFFSET

(71) Applicant: Southwest Research Institute, San Antonio, TX (US)

(72) Inventors: Riccardo Meldolesi, Hove (GB); Roy Granville, Shoreham-by-Sea (GB)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 772 days.

(21) Appl. No.: 14/880,253

(22) Filed: Oct. 11, 2015

(65) Prior Publication Data

US 2017/0101930 A1 Apr. 13, 2017

(51) Int. Cl.

| | |
|---|---|
| ***F02B 77/08*** | (2006.01) |
| ***F02F 7/00*** | (2006.01) |
| ***F02B 75/04*** | (2006.01) |
| *F02F 3/00* | (2006.01) |
| *F02F 1/24* | (2006.01) |
| *F02F 1/18* | (2006.01) |

(52) U.S. Cl.
CPC ..... *F02B 75/047* (2013.01); *F02F 7/0019* (2013.01)

(58) Field of Classification Search
CPC ..... F02B 75/047; F02B 75/041; F02B 77/08; F02F 7/0019; F02F 1/24; F02F 1/18; G01M 15/00; G01M 15/04
See application file for complete search history.

(56) References Cited

U.S. PATENT DOCUMENTS

| | | | | |
|---|---|---|---|---|
| 3,079,802 A * | 3/1963 | Fibikar | G01M 1/22 | 73/466 |
| 5,025,757 A * | 6/1991 | Larsen | F02B 59/00 | 123/48 R |
| 8,991,354 B2 * | 3/2015 | Lewis | F02F 7/0019 | 123/193.1 |
| 2011/0308307 A1 * | 12/2011 | Schneider | G01M 13/027 | 73/114.26 |

* cited by examiner

*Primary Examiner* — Grant Moubry
(74) *Attorney, Agent, or Firm* — Livingston Law Firm

(57) ABSTRACT

A set of mechanisms, for use with an internal combustion test engine, for testing cylinder offset during operation of the engine. The test engine specifics may vary, but it is assumed to have a crankcase base that supports a cylinder barrel and cylinder head. During engine operation, a transit plate is secured to the top surface of the crankshaft base, and a pair of wedge plates is secured between the transit plate and the bottom of the cylinder barrel. When the engine is not in operation, the transit plate can be slid in a direction normal to the crankshaft axis (for cylinder offset adjustment), and the wedge plates can be moved relative to each other (for cylinder height adjustment).

14 Claims, 11 Drawing Sheets

INTERNAL COMBUSTION TEST ENGINE WITH SYSTEM AND METHOD FOR ADJUSTING CYLINDER OFFSET

TECHNICAL FIELD OF THE INVENTION

This invention relates to internal combustion engines, and more particularly to systems and methods for testing such engines.

BACKGROUND OF THE INVENTION

In recent years, it is becoming more common for new engine designs to have their cylinders offset from their crankshaft axes. In other words, each cylinder is positioned with its bore axis slightly offset from the center line of the crankshaft. Engines having these cylinder configurations are referred to as "offset cylinder", "crank offset", or "Désaxé" engines.

Typically, a reference to an "offset cylinder" engine is to an internal combustion automotive or motorcycle engine. The offset configuration can have the advantages of increased torque on the crankshaft, as well as reduction in frictional forces between the piston and cylinder.

Experimental testing to determine the effect of cylinder offset is problematic. For a production engine, a new cylinder block casting is needed for each value of offset to be evaluated. Furthermore, with each different offset, to maintain the same compression ratio, either the connecting rod length or the cylinder block height must be adjusted. Adjusting the connecting rod length complicates the testing, and adjusting block height is often impractical.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to an internal combustion test engine having simple mechanisms for testing cylinder offset. These mechanisms are added to a standard test engine, and allow both cylinder offset and cylinder height to be easily varied over a given range. In this manner, a series of test measurements can be made at different cylinder offset values to fully evaluate the effect of cylinder offset.

Figure 2:
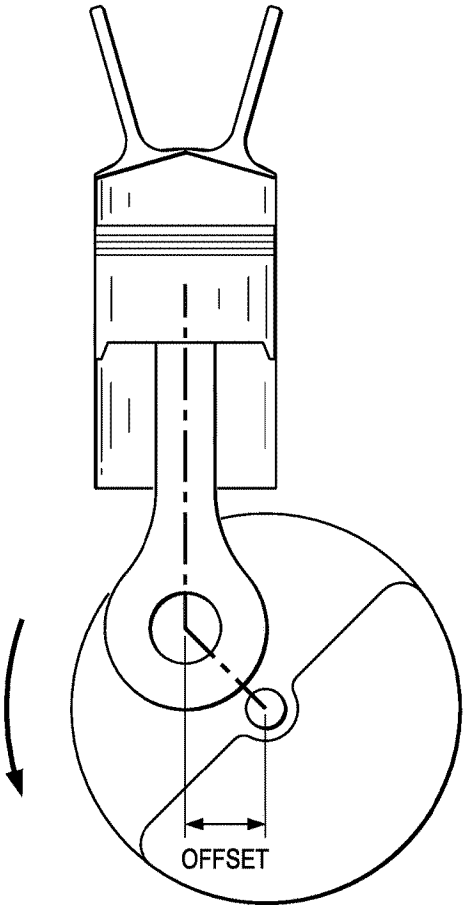
FIG. 2 (PRIOR ART)
FIGS. 1 and 2 illustrate a conventional (non offset) and an offset cylinder, respectively.
Figure 1:
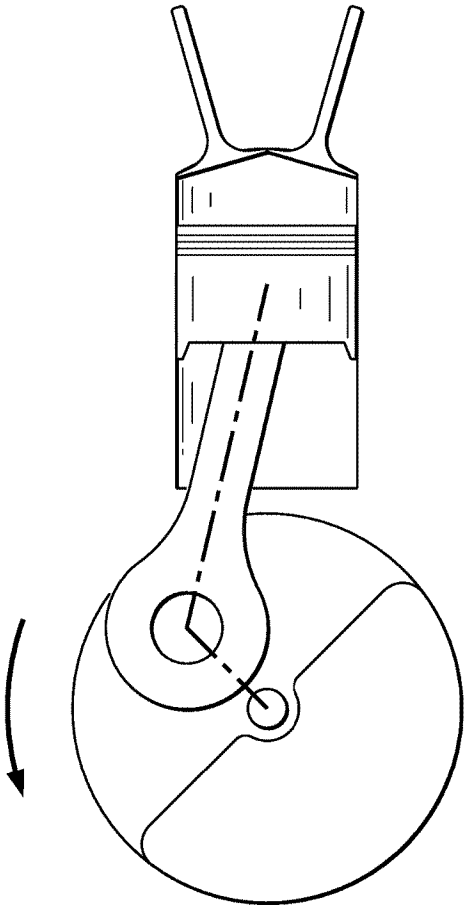
FIG. 1 (PRIOR ART)

FIGS. 1 and 2 illustrate a conventional (non offset) and an offset cylinder, respectively. As illustrated, in the offset cylinder, the cylinder's centerline is offset from the center of the crankshaft. This offset in intended to reduce the resistance applied between the piston and the cylinder during the expansion stroke.

As stated above, the offset adjustment mechanisms described herein are for use with an internal combustion test engine. For purposes of this description, the test engine is a single cylinder research engine that replicates the operation of light and medium duty production engines. An example of a suitable research engine is one developed by Southwest Research Institute and described in various publications of the Institute, which are incorporated herein by reference.

Figure 3:
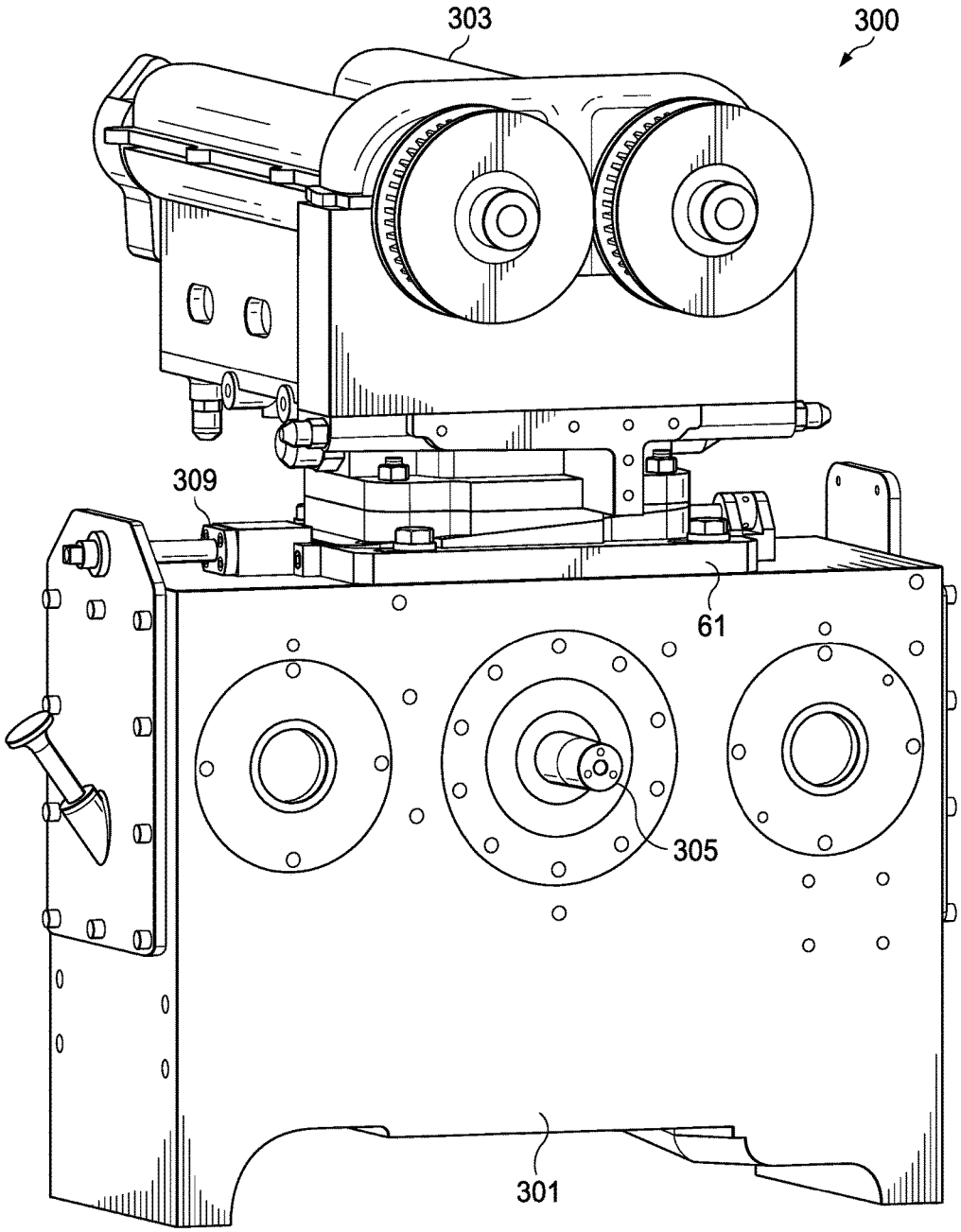
FIG. 3 is a front external view of a test engine in accordance with the invention.

FIG. 3 is a front external view of a test engine 300 in accordance with the invention. Various elements of test engine 300 relevant to the invention are described below. Additional features for proper engine operation, such as external circuits for coolant, lubrication, air induction, etc., may be added.

A crankcase 301 forms the base of the engine 300, and all other components are installed onto this base. Crankcase 301 houses the crankshaft 305 (shown in part), and provides a support base for the cylinder elements. Cylinder head 303 is atop a cylinder barrel, the latter being more clearly shown in subsequent figures. Cylinder head 303 may be a production multi-cylinder head where only one cylinder is used, or a specially designed single cylinder head.

Figure 4:
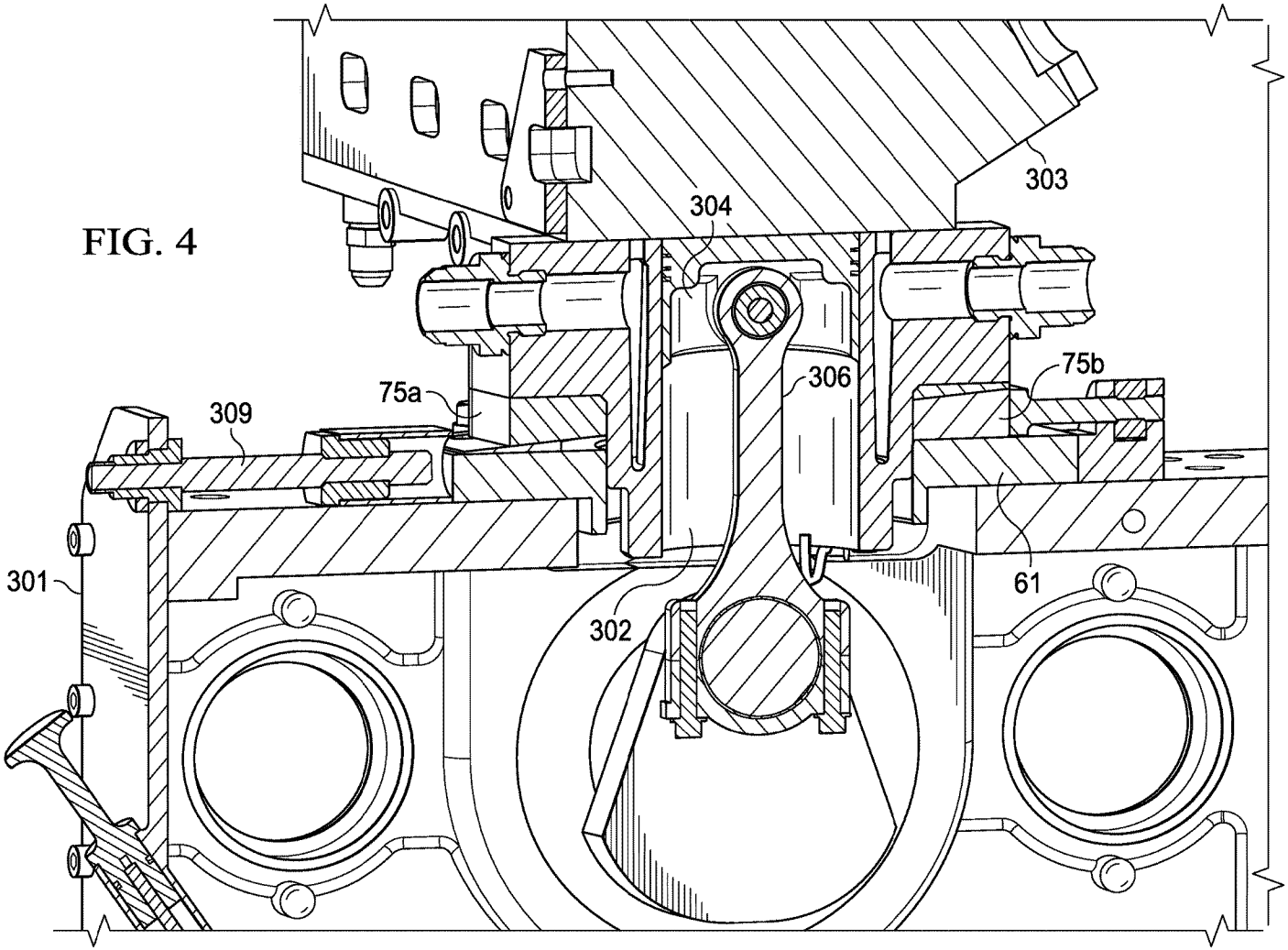
FIG. 4 is a cross sectional front view of a portion of the test engine of FIG. 3, in particular, of its cylinder, piston, and crankshaft configuration.

FIG. 4 is a cross sectional front view of a portion of test engine 300, in particular, of its cylinder, piston, and crankshaft configuration. Cylinder head 303 is supported by cylinder barrel 302, which has a bore for the piston 304. Crankshaft 305 is driven by the piston 304 via a connecting rod 306.

Figure 4A:
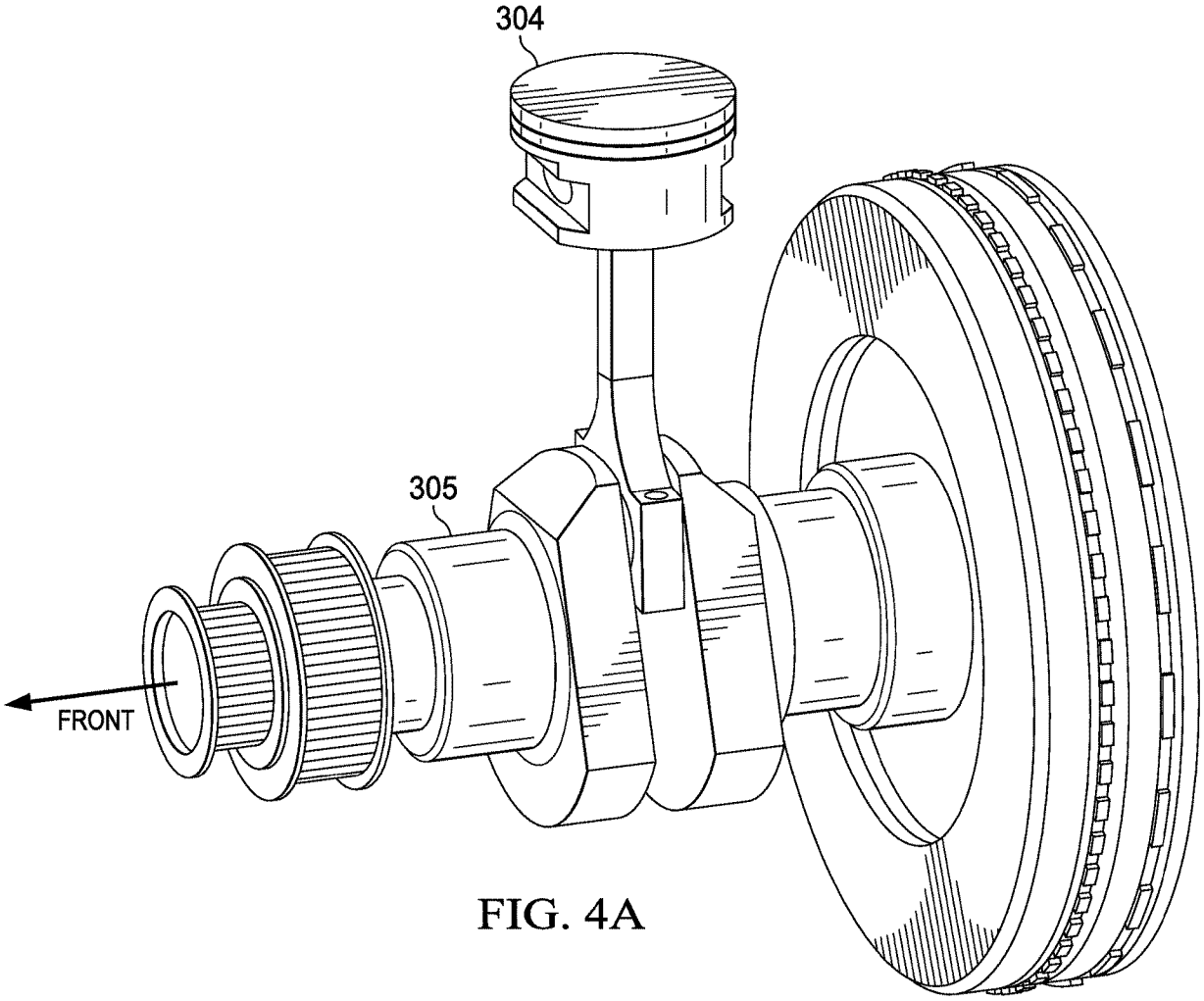
FIG. 4A illustrates the piston, crankshaft, and connecting rod.

FIG. 4A illustrates piston 304, crankshaft 305, and connecting rod 306 in further detail. These elements may be removable from test engine 300.

A feature of test engine 300, but not significant to the invention, is that cylinder barrel 302 can be changed when a different cylinder is desired to be tested. However, for purposes of this description, cylinder offset testing as described herein is typically performed with the same cylinder at different cylinder offset positions.

Figure 5:
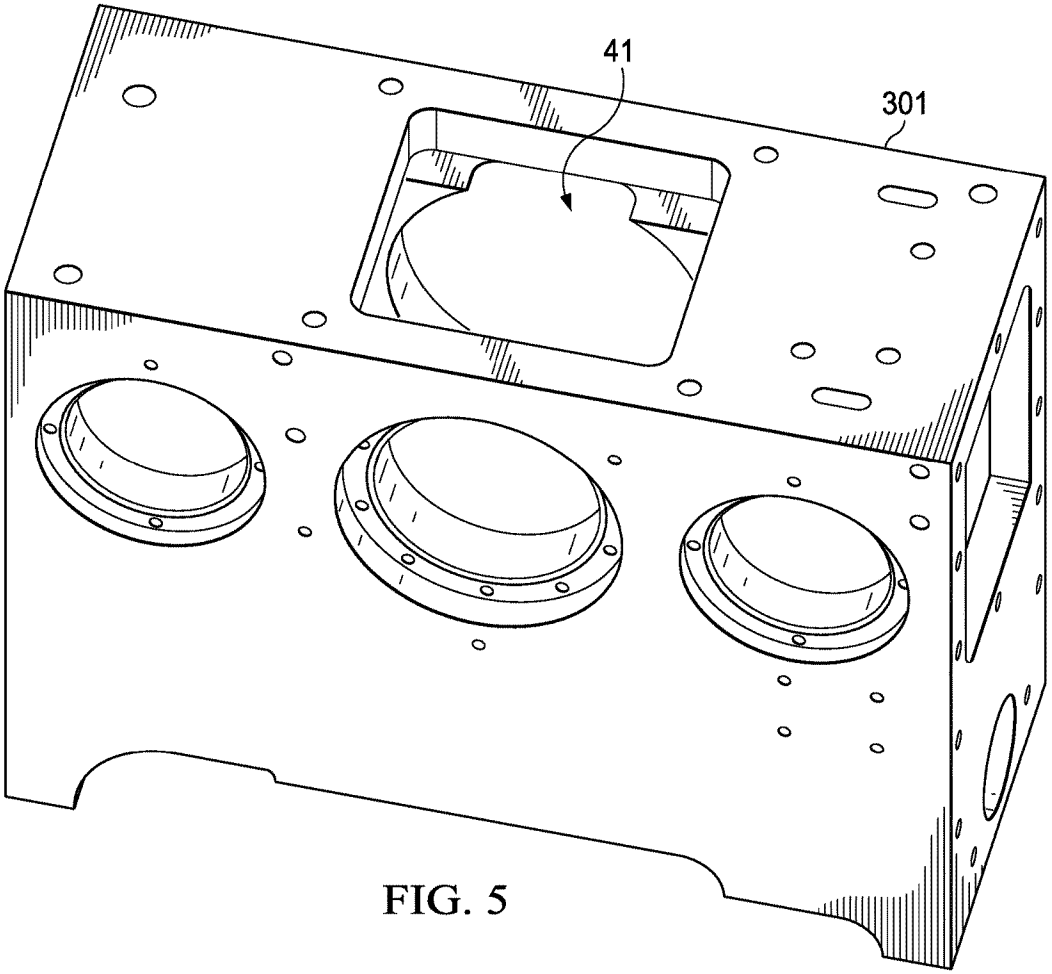
FIG. 5 is a perspective front view of the crankcase, with the rest of the test engine components removed.

FIG. 5 is a perspective front view of crankcase 301, with the rest of the test engine components removed. The crankcase 301 has a flat top surface, with an opening 41. Referring to FIGS. 3-5, the cylinder bore portion of the cylinder barrel 302 is placed through this opening 41 for connection to the connecting rod 306 and crankshaft 305.

Figure 6:
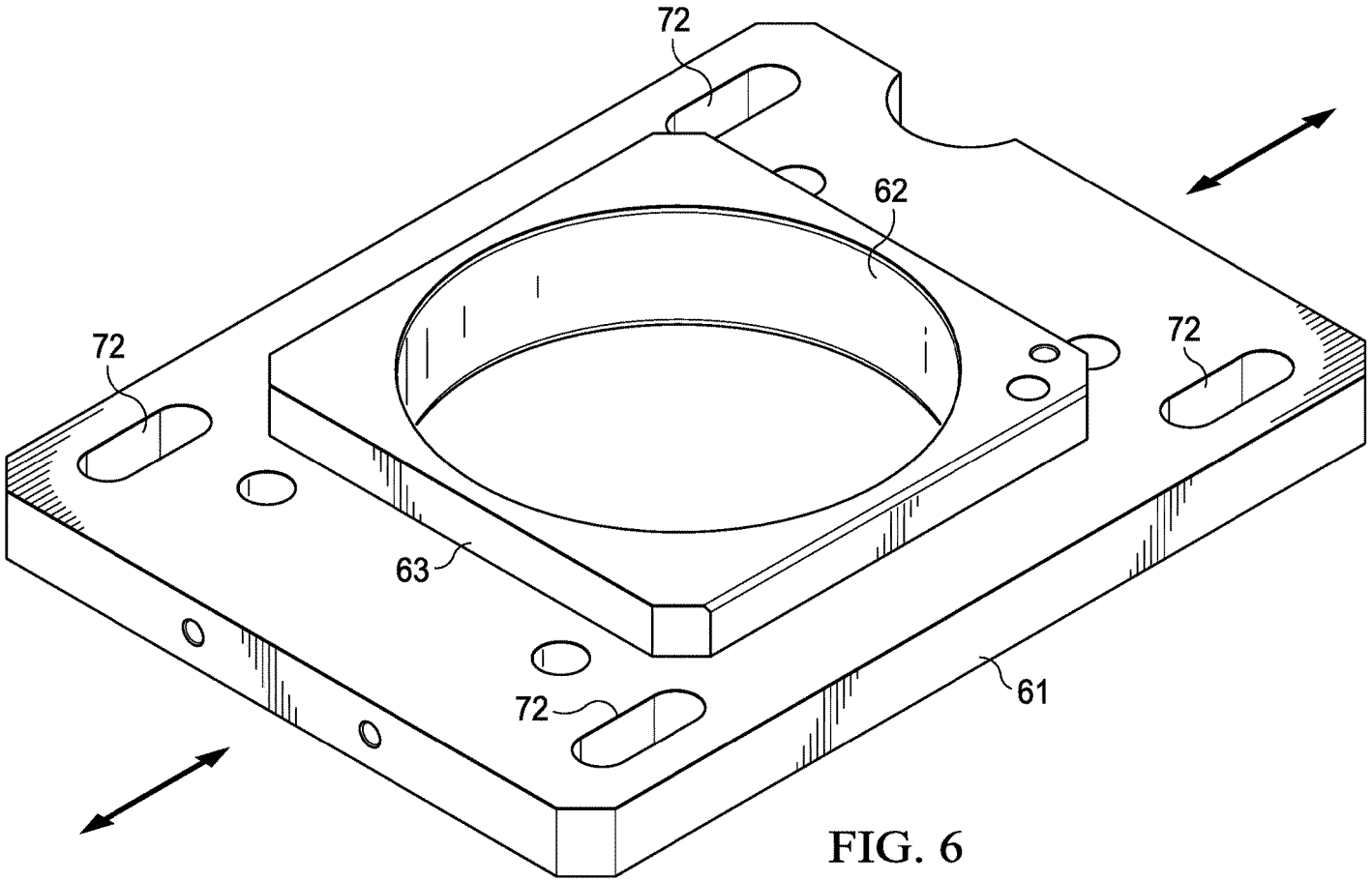
FIG. 6 illustrates a transit plate used for adjusting cylinder offset.

FIG. 6 illustrates a transit plate 61 used for adjusting cylinder offset. In the view of FIG. 6, transit plate 61 is "upside down", that is, its underside is shown.

Referring again to FIGS. 3 and 4, transit plate 61 is shown in position for use, interposed between the crankcase 301 and cylinder barrel 302. Transit plate 61 has a circular hole 62 in its center, through which the bore portion of cylinder barrel 302 is placed. The upper portion of cylinder barrel 302 is above, and rests upon, transit plate 61.

Referring again to FIG. 5, transit plate 61 is placed atop the rectangular hole 41 in the top of the crankcase 301. The edges of transit plate rest outside the perimeter of the opening 41, and the raised portion 63 that surrounds opening 62 drops into the hole 41.

As indicated by the arrows in FIG. 6, for cylinder offset adjustment, transit plate 61 is moveable by sliding it in a direction normal to the axis of crankshaft 305. This sliding motion may be accomplished manually, or by various mechanisms. In the example of this description, the sliding movement is controlled by a screw jack 309, which allows fine adjustment of position.

When transit plate 61 is moved in this manner, the cylinder barrel 302 and cylinder head 303, which are attached to and supported by transit plate 61, move with it in the same direction and by the same amount. This movement changes the position of the cylinder bore relative to the crankshaft axis, and hence, changes the cylinder offset. It is expected that cylinder offsets in a range of 20 mm or more can be achieved by moving transit plate 61.

Figure 7:
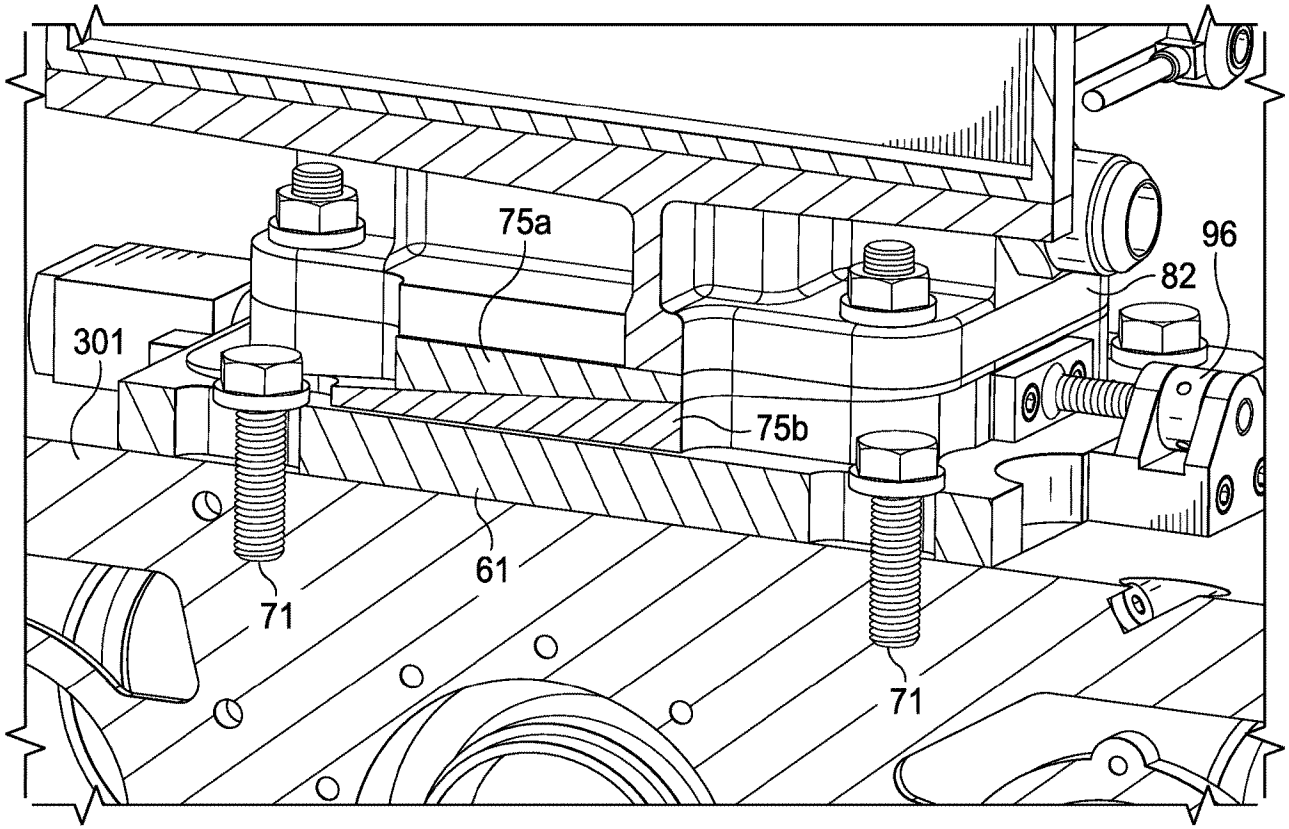
FIG. 7 is a more detailed view of the location of the transit plate on the top of the crankcase and below the cylinder barrel.

FIG. 7 is a more detailed view of the location of transit plate 61 on the top of the crankcase 301 and below a supporting flange 82 of cylinder barrel 302. A pair of wedge plates 75*a* and 75*b* is interposed between the transit plate 61 and cylinder barrel 302, and is described below.

Referring to FIGS. 6 and 7, transit plate 61 is normally secured to crankcase 301 by bolts 71 in slots 72. Bolts 71 are loosened to allow for offset adjustment. Thus, it is not intended for adjustment of transit plate 61 to be carried out while the engine is running. The slots 72 allow the bolts 71 to be loosened so that transit plate can be moved, and then to retightened to re-secure transit plate 61 to crankcase 301.

As stated in the Background, to maintain a constant compression ratio when cylinder offset adjustments are made, one approach is to adjust the cylinder height. As illustrated most clearly in FIG. 7, for cylinder height adjustment, a pair of wedge shaped plates 75*a* and 75*b* is interposed between the transit plate 61 and the bottom surface of cylinder barrel 302.

Wedge plates 75*a* and 75*b* have matching angles on their mating (adjacent) faces. The angle of the faces is sufficiently small (4.5° in this case) to be "self-locking". In other words, wedge plates 75*a* and 75*b* will not move laterally in response to a vertical loading.

Self-locking angles larger than 4.5° are possible by configuring the mating surfaces of wedge plates 75*a* and 75*b* so that the dry friction coefficient between them is sufficiently high. Where F is the dry friction coefficient between the two mating surfaces, the relationship between F and the maximum wedge angle, a, which allows a self-locking operation is:

$$F=\tan(\alpha).$$

Friction coefficients of up to 0.5 are possible by choosing the appropriate surface settings. For example, a friction enhancing coating could be used. An example of a suitable coating is offered by the company EKAGRIP. This coating has small diamonds embedded onto the surface, which "dig" onto the mating surface and significantly increases the dry friction coefficient.

If a working friction coefficient is adopted, it is expected that a maximum self-locking wedge angle could be 30° (0.5=tan(30°). This range of face angles between wedge plates 75*a* and 75*b* allows substantial changes in compression ratios for relatively small horizontal movement of the wedge plates.

Figure 8:
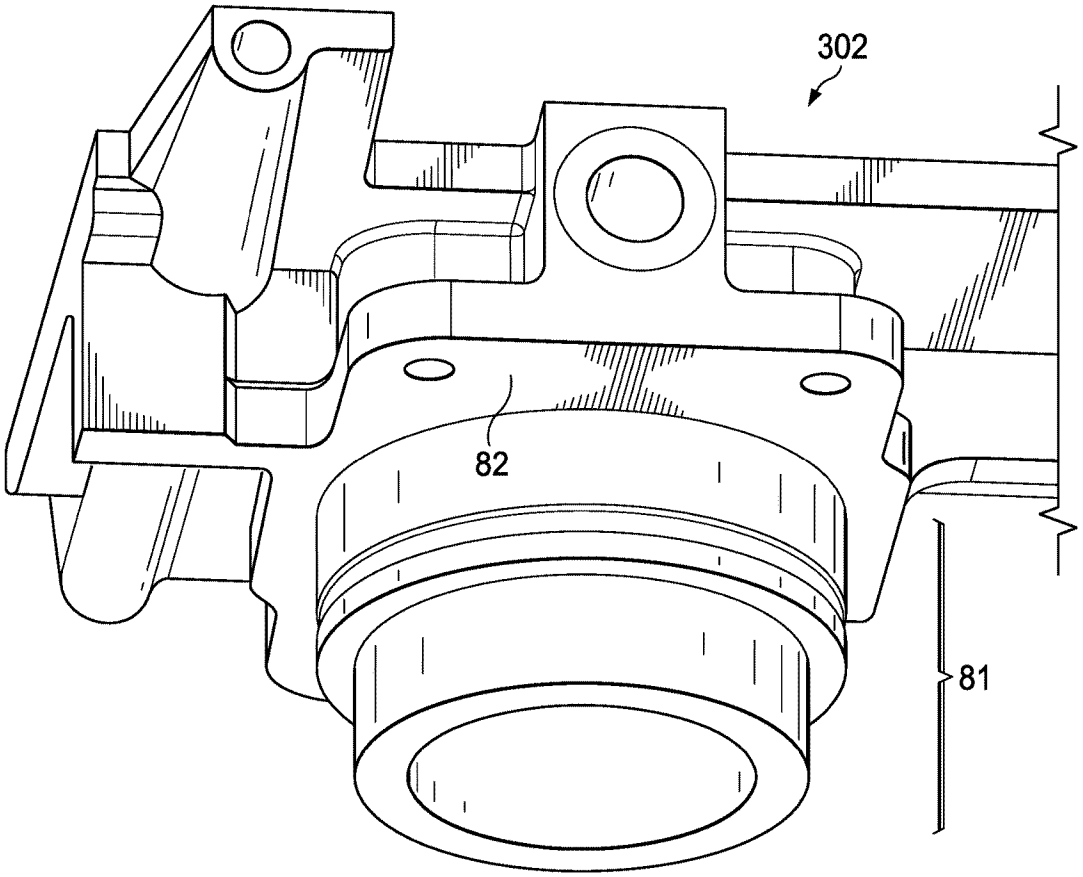
FIG. 8 is a more detailed view of the cylinder barrel, generally shown in its orientation when installed in the test engine.

FIG. 8 is a more detailed view of cylinder barrel 302, generally shown in its orientation when installed in test engine 300. Referring in particular to FIGS. 5-8, it can be seen that the lower portion 81 of the cylinder barrel 302 defines the cylinder bore. This lower portion fits through the opening 41 in the top of the crankcase, through the opening 62 in the transit plate, and through the upper and lower wedge plates 75*a* and 75*b*. The supporting flange 82 of cylinder barrel 302 rests upon upper wedge plate 75*a*.

Figure 9:
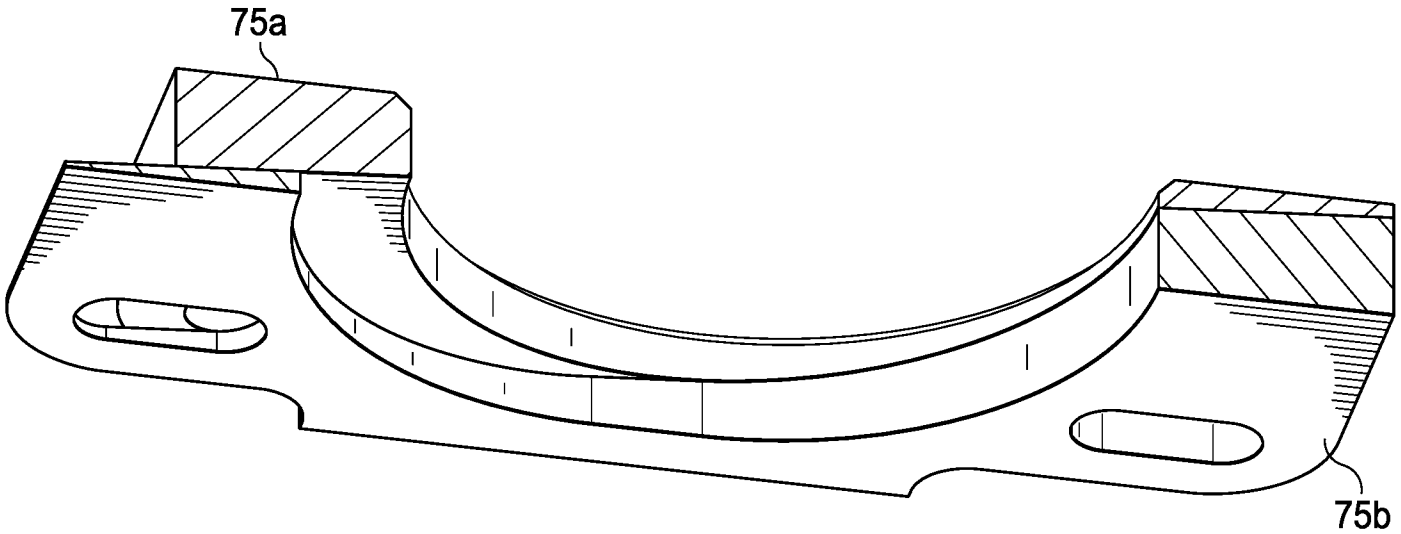
FIG. 9 is a cross sectional view through the center line of the upper and lower wedge plates.

FIG. 9 is a cross sectional view through the center line of upper wedge plate 75*a* and lower wedge plate 75*b*. As illustrated, upper wedge plate 75*a* has a circular hole, and lower wedge plate 75*b* has an elongated hole. The lower portion 81 of cylinder barrel 302 (which includes the cylinder bore) passes through these holes. As a result, the lower wedge plate 75*b* can slide relative to cylinder barrel 302 and upper wedge plate 75*a*, in a direction normal to the crankshaft axis 305.

By sliding the wedge plates 75*a* and 75*b* relative to each other laterally, the vertical position of the cylinder barrel 302 is changed due to the action of the wedge plates. The lateral position of the cylinder barrel 302 is not affected by this movement.

Figure 10:
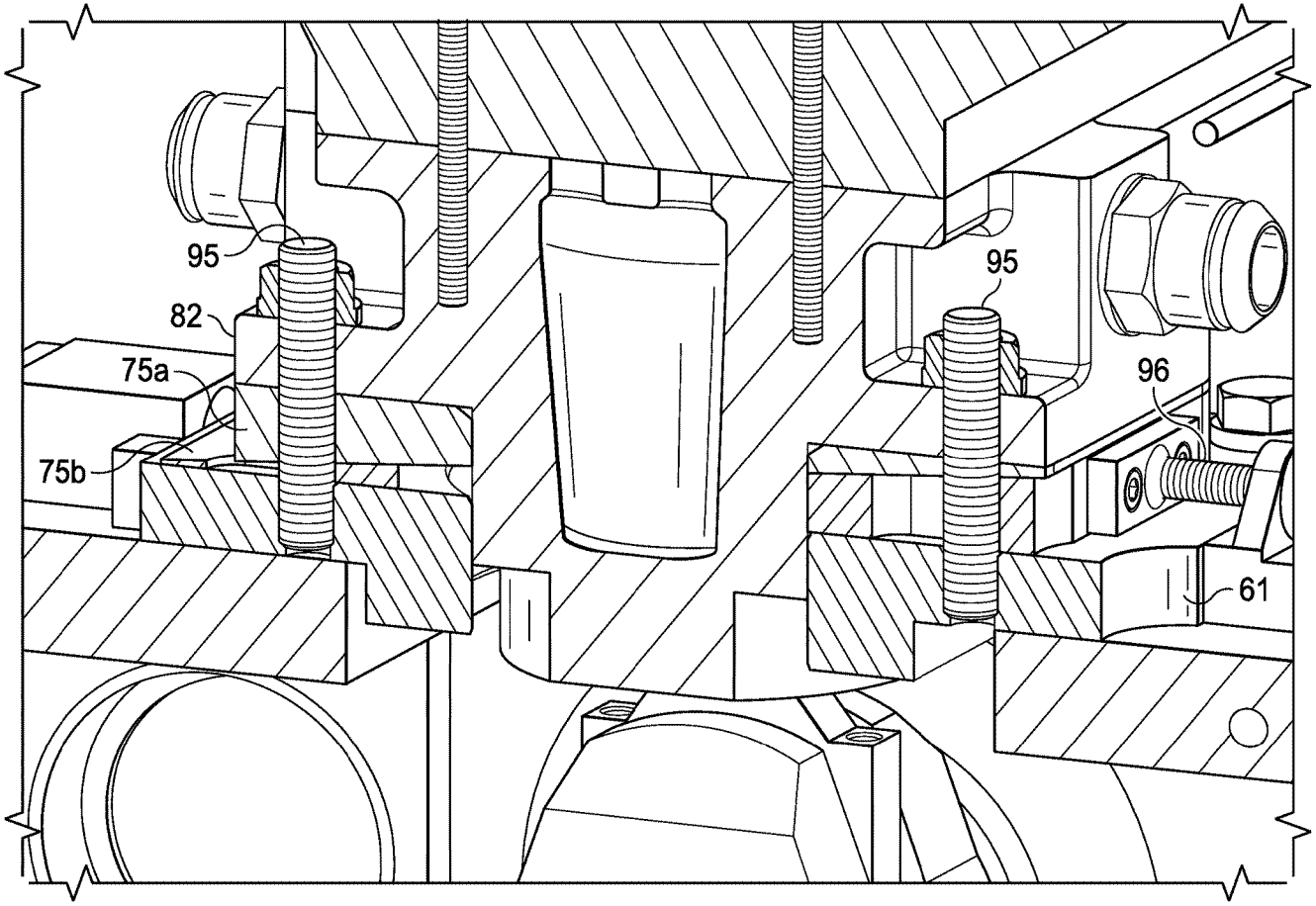
FIG. 10 is a cross sectional view of the cylinder barrel, transit plate, and upper and lower wedge plates.

FIG. 10 is a cross sectional view of cylinder barrel 302, transit plate 61, and upper and lower wedge plates 75*a* and 75*b*. Bolts 95 are placed at each corner of the supporting flange 82 of cylinder barrel 302. During engine operation, these bolts 95 securely fasten the cylinder barrel 302 to the pair of wedge plates 75*a* and 75*b* and to the transit plate 61. Bolts 95 are loosened to allow sliding movement of lower wedge plate 75*b* for cylinder height adjustment.

Like the adjustment of transit plate 61, it is not intended for the adjustment of wedge plates 75*a* and 75*b* to be carried out while the test engine is running. The cylinder barrel 302 and wedge plates 75*a* and 75*b* are normally secured to the transit plate 61 by bolts 95 or other fasteners, which must be loosened to allow for offset adjustment. In the present example, bolts 95 are fitted into the transit plate 61. These pass through slotted holes in the lower wedge plate 75*b*, then round holes in the upper wedge plate 75*a* and lower flange 82 of the cylinder barrel. Nuts acting on the barrel flange 82 tighten the whole assembly together.

The sliding movement of the wedge plates 75*a* and 75*b* relative to each other may be controlled manually or by various mechanisms. In the example of this description, the sliding movement is controlled by a screw jack 96 attached to the lower wedge plate 75*b*, which allows fine adjustment of position.

Typically, for testing cylinder offset, transit plate 61 is moved laterally as described above, to provide successive new offset positions. For each new cylinder offset position, wedge plates 75*a* and 75*b* are also moved relative to each other to adjust the cylinder height. This maintains a constant compression ratio and other operating parameters of the cylinder so that the effects of cylinder offset are isolated. The combination of the two mechanisms together provides a convenient solution to the requirement to adjust both cylinder offset and cylinder height.

Figure 11:
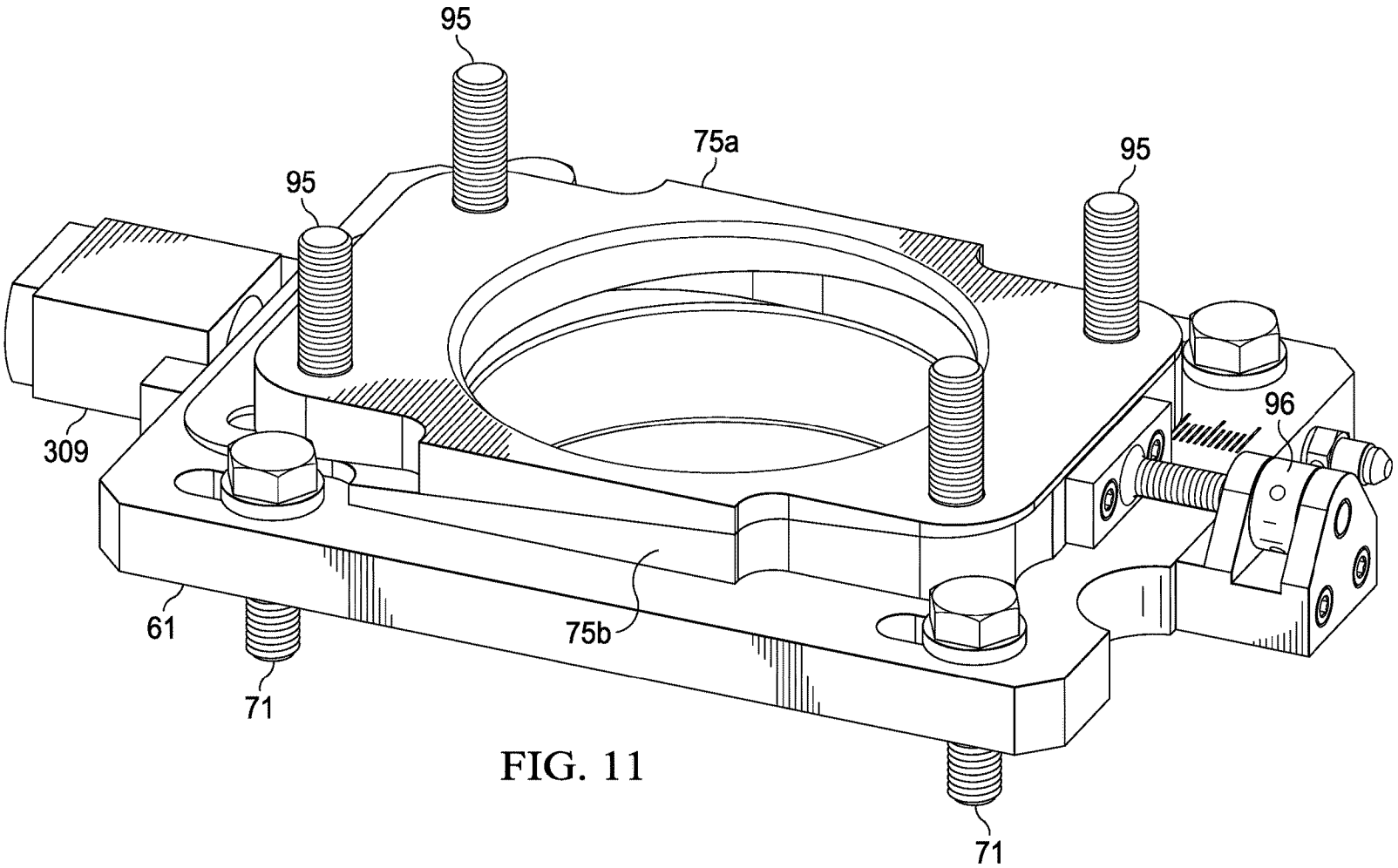
FIG. 11 is a perspective view of the transit plate and the wedge plates.

FIG. 11 further illustrates transit plate 61 and wedge plates 75*a* and 75*b*. In a conventional test engine having a crankcase base that supports a cylinder barrel and cylinder head, these components can be installed as a unit for cylinder offset testing. Bolts 71 and 95 are shown as the means for fixedly attaching the transit plate 61 and wedge plates 75*a* and 75*b* to each other and to the test engine during engine operation. However for all embodiments, other attachment means could be used, such as clamps, provided that they may be loosened for adjusting cylinder offset and cylinder height as described above.

Alternatively, transit plate 61 and wedge plates 75*a* and 75*b* may be used separately. If only transit plate 61 is installed in test engine 300, it would be fixedly attached to the top of the crankcase 301 with bolts 71, as well as to cylinder barrel flange 82 with additional bolts or other attachment means during operation of the engine. As described above, bolts 71 are loosened for cylinder offset adjustment. If only transit plate 61 is installed, some other means may be used to control cylinder height and compression ratio.

Wedge plates 75*a* and 75*b* could be used to adjust compression ratio alone without the use of transit plate 61. However, the self-locking taper angles limit the practicably available height adjustment so that the range of compression ratio change would be rather limited. Fixed thickness shims can be also added under the barrel to make larger changes to compression ratio.

What is claimed is:

1. A test engine for testing cylinder offset during operation of an internal combustion cylinder, comprising:

a crankcase base;

a cylinder barrel having a cylinder bore and having a cylinder barrel flange around the cylinder bore;

a cylinder head mounted above the cylinder barrel;

a crankshaft supported within the crankcase base, the crankshaft having a connecting rod and piston;

wherein the crankcase base has an opening in its top surface for receiving the cylinder bore; a transit plate interposed between the barrel flange and the top of the crankcase base, and having an opening for receiving the cylinder bore;

wherein the transit plate is configured to be fixedly attached to the crankcase base and cylinder barrel during operation of the test engine, but slidably moveable across the top surface of the crankcase base in a direction normal to the crankshaft axis when the test engine is not in operation.

2. The test engine of claim 1, wherein the transit plate has elongated bolt slots in each corner, and is fixedly attached to the crankcase base with bolts in the bolt slots during operation of the test engine.

3. The test engine of claim 1, further comprising a pair of wedge plates interposed between the transit plate and the cylinder barrel flange.

4. The test engine of claim 3, wherein the wedge plates are fixedly attached to the transit plate and barrel flange during operation of the engine, and slidably moveable relative to each other when the engine is not in operation.

5. The test engine of claim 3, wherein the adjacent faces of the wedge plates are self-locking.

6. The test engine of claim 5, wherein the wedge plates have a taper angle of their adjacent faces that is sufficiently small as to be self-locking when placed between the transit plate and cylinder barrel.

7. The test engine of claim 5, wherein the faces of the wedge plates are self-locking by means of the friction of their surfaces.

8. A device, for use with an internal combustion test engine, for testing cylinder offset during operation of the engine, the test engine having a crankcase base that supports a cylinder barrel and cylinder head, comprising:

a transit plate configured to be fixedly attached to the top surface of the crankcase base during operation of the test engine, but slidably moveable across the top surface of the crankcase base in a direction normal to the crankshaft axis when the test engine is not in operation; and a pair of wedge plates configured to be fixedly attached between the transit plate and the bottom of the cylinder barrel during operation of the engine, and slidably moveable relative to each other when the engine is not in operation.

9. The device of claim 8, wherein the transit plate has elongated bolt slots in each corner, and is fixedly attached to the crankcase base with bolts in the bolt slots during operation of the test engine.

10. The device of claim 8, wherein the adjacent faces of the wedge plates are self-locking.

11. The device of claim 10, wherein the wedge plates have a taper angle of their adjacent faces that is sufficiently small as to be self-locking when placed between the transit plate and cylinder barrel.

12. The device of claim 10, wherein the faces of the wedge plates are self-locking by means of the friction of their surfaces.

13. The device of claim 8, wherein the lower wedge plate has elongated bolt slots in each corner, and is fixedly attached to the transit case, the upper wedge plate, and the cylinder barrel with bolts in the bolt slots during operation of the test engine.

14. The device of claim 8, wherein the cylinder barrel has a lower portion comprising a cylinder bore, which is received into openings in the top of the crankcase base, the transit plate, and the pair of wedge plates.

* * * * *